US007323979B2

(12) United States Patent
Eskildsen

(10) Patent No.: US 7,323,979 B2
(45) Date of Patent: Jan. 29, 2008

(54) DUAL TECHNOLOGY GLASS BREAKAGE DETECTOR

(75) Inventor: Kenneth G. Eskildsen, Great Neck, NY (US)

(73) Assignee: Honeywell International, Inc., Morristown, NJ (US)

( * ) Notice: Subject to any disclaimer, the term of this patent is extended or adjusted under 35 U.S.C. 154(b) by 239 days.

(21) Appl. No.: 10/853,361

(22) Filed: May 25, 2004

(65) Prior Publication Data

US 2005/0264413 A1 Dec. 1, 2005

(51) Int. Cl.
*G08B 19/00* (2006.01)

(52) U.S. Cl. ..... 340/521; 522/545.9

(58) Field of Classification Search ..... 340/545.1, 340/545.2, 545.5, 545.9, 566, 522, 521
See application file for complete search history.

(56) References Cited

U.S. PATENT DOCUMENTS 3,863,250 A * 1/1975 McCluskey, Jr. ..... 340/550
3,889,250 A 6/1975 Solomon
4,091,660 A 5/1978 Yanagi
4,134,109 A 1/1979 McCormick et al.
4,668,941 A 5/1987 Davenport et al.
4,837,558 A 6/1989 Abel et al.
4,853,677 A 8/1989 Yarbrough et al.
5,117,220 A * 5/1992 Marino et al. ..... 340/550
5,192,931 A 3/1993 Smith et al.
6,624,750 B1 * 9/2003 Marman et al. ..... 340/506
6,907,388 B2 * 6/2005 Suzuki et al. ..... 702/188
2004/0135683 A1 * 7/2004 Sakai ..... 340/522
2005/0128068 A1 * 6/2005 Winick et al. ..... 340/517

* cited by examiner

*Primary Examiner*—Jeffery Hofsass
*Assistant Examiner*—Hongmin Fan
(74) *Attorney, Agent, or Firm*—Scully, Scott, Murphy & Presser PC

(57) ABSTRACT

A dual technology glass breakage detector for a security system that detects the breaking of glass in a window or door without generating false alarms caused by similar types of sounds. The dual technology glass breakage detector includes an acoustic sensor/audio processor for detecting a sound of breaking glass within a premises protected by the security system, and also a second impact sensor mounted on the glass window or door to verify that there was a physical/mechanical impact to the glass window or door before the security system annunciates an alarm signal.

14 Claims, 3 Drawing Sheets

DUAL TECHNOLOGY GLASS BREAKAGE DETECTOR

BACKGROUND OF THE INVENTION

1. Field of the Invention

The present invention relates generally to a dual technology glass breakage detector, and more particularly pertains to a dual technology glass breakage detector for a security system that includes an acoustic sensor/audio processor for detecting a sound of breaking glass of a glass window or door, and also a second impact sensor mounted on the glass window or door to verify that there was a physical/mechanical impact to the glass window or door before the security system annunciates an alarm signal.

2. Discussion of the Prior Art

The present invention addresses the commercial problem of a security system, such as a commercial or residential/home security system, providing a glass breakage sensor for detecting an intrusion into a protected space through a glass window or door. Existing prior art glass breakage sensors designed to detect the breakage of glass windows or doors are problematic.

One current state of the art glass breakage sensor employs a microphone and an audio processor, typically strategically mounted on a ceiling, to monitor sounds within a protected space to determine if glass in a glass window or door has been broken. A problem with this arrangement is that sounds other than those of breaking glass from a glass window or door can fool the audio processor and cause the issuance of a false alarm by the security system. Some examples of sounds that can fool the audio processor and cause the issuance of false alarms include sounds of a barking dog, the popping of a balloon, a dropping of a pot or pan, an accidental dropping and breakage of a drinking glass, and the closing of a kitchen cabinet.

The present invention provides a dual technology glass breakage detector that solves the prior art problem of acoustic glass breakage detectors issuing false alarms by using a second impact sensor to verify that the window or door also experienced a mechanical/physical impact. Sounds within the protected space that would normally fool a prior art glass breakage detector usually do not transfer significant mechanical energy to the glass window or door. Pursuant to the present invention, for an alarm to be annunciated, the acoustic sensor must detect the sound of breaking glass, and also a second impact sensor on the glass window or door must verify that there was a physical/mechanical impact to the glass window or door.

SUMMARY OF THE INVENTION

The present invention provides a dual technology glass breakage detector for a security system that detects the breaking of glass in a window or door without false alarming on similar types of sounds. The dual technology glass breakage detector includes an acoustic sensor/audio processor for detecting a sound of breaking glass of a glass window or door within a premises protected by the security system, and also a second impact sensor mounted on the glass window or door to verify that there was a physical/mechanical impact to the glass window or door before the security system annunciates an alarm signal.

BRIEF DESCRIPTION OF THE DRAWINGS

The foregoing objects and advantages of the present invention for a dual technology glass breakage detector may be more readily understood by one skilled in the art with reference being had to the following detailed description of several embodiments thereof, taken in conjunction with the accompanying drawings in which.

DETAILED DESCRIPTION OF THE INVENTION

Figure 1:
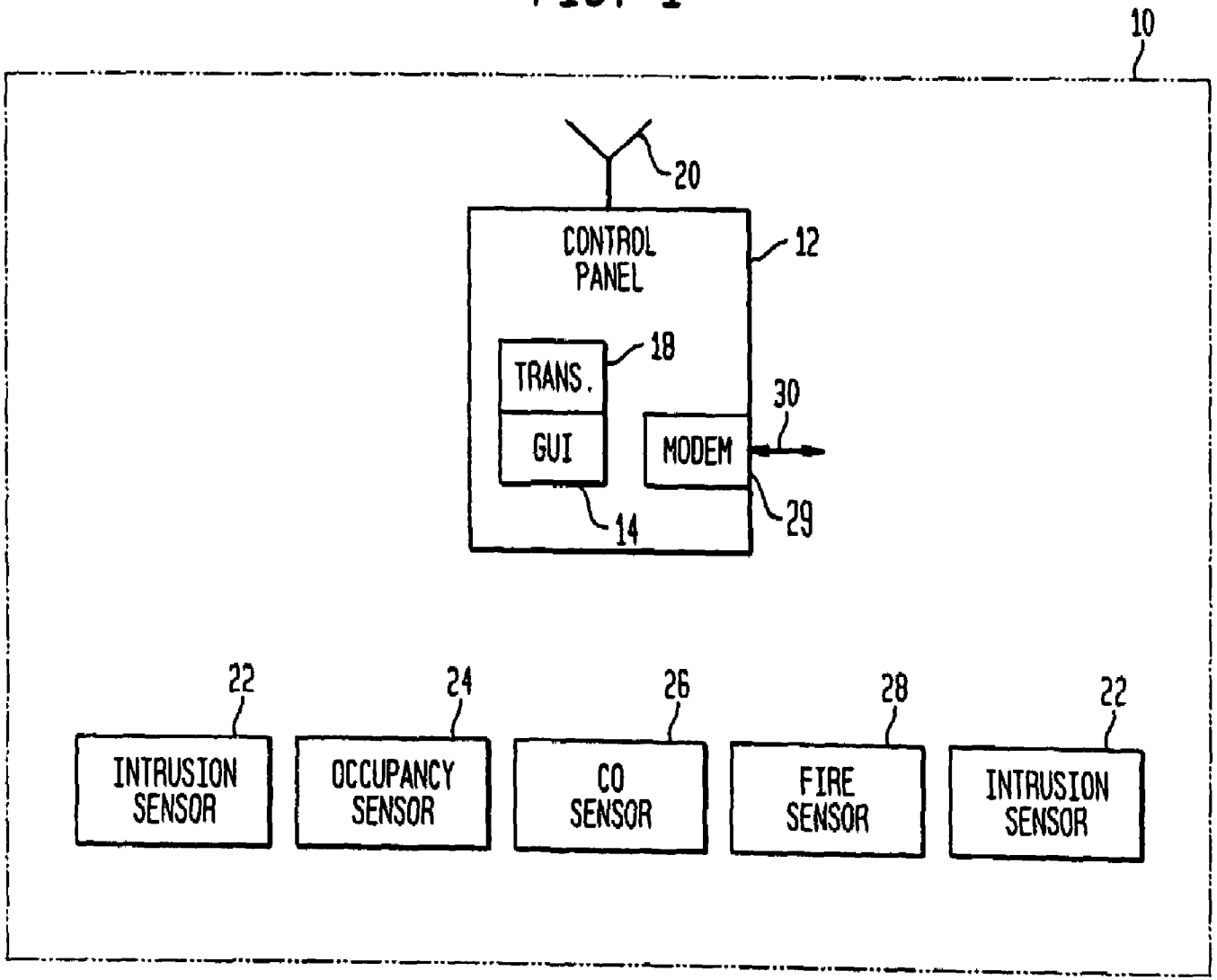
FIG. 1 PRIOR ART
FIG. 1 illustrates a typical security system for a residential or commercial premises that comprises a security system control panel provided at a central accessible location and a plurality of intrusion security detectors, such as glass breakage detectors, mounted near doors and windows.

FIG. 1 illustrates a typical security system 10 for a residential or commercial premises that comprises a security system control panel 12 provided at a central accessible location, such as just inside the front entrance of the premises protected by the security alarm system. The control panel provides a person or homeowner with a display 14 of information on the complete status of the security system, such as a display of pertinent parameters and conditions of the security system.

The control panel also enables a person to control operation of the security system, such as arming or disarming of the security system by entry of a proper security code and of specific commands. The control panel might include a GUI display (graphical user interface) 14 to enable a user to view the status of the security alarm system and also to enter data into and access and control the security system.

The security system control panel also includes an RF transceiver 18 and antenna 20 to transmit and receive RF transmitted data, and the security system might be a wireless system, with many of the communications between sensors and the control panel being by short range RF communication messages.

A typical residential or commercial security system also includes a plurality of intrusion security detectors 22 mounted near doors and windows, such as glass breakage detectors, to detect any intrusions thereat, and motion/occupancy sensors 24 mounted at strategic locations in the premises to detect the presence of a person thereat, which are connected by security system wiring or wireless transmissions to the security system control panel. A typical security system might also include one or more CO sensors 26 and smoke or fire sensors 28 mounted at strategic locations in the premises to detect any of those conditions in the premises, with those sensors also being connected by security system wiring or short range RF transmissions to the security system control panel. The security system control panel monitors signals from the security system sensors to determine the status of the security system.

A typical residential or commercial security system might also include a modem 29 and a telephone line or cable connection to allow bi-directional data communications over telephone lines and/or a cable system and/or the internet, as indicated schematically at 30.

Pursuant to the present invention, for an alarm to be annunciated by a security system, an acoustic sensor/audio processor must detect the sound of breaking glass, and also a second impact sensor mounted on a glass window or door must verify that there was a physical/mechanical impact to the glass of the window or door. A preferred embodiment of the present invention for a dual technology glass breakage detector employs a first acoustic sensor/audio processor mounted within the perimeter of the protected space, and a second impact sensor mounted on the glass window or door to be protected. The first acoustic sensor can be conveniently mounted on the ceiling at an appropriate strategic central location. A smaller and less expensive impact sensor is mounted on each glass window or door to be monitored for breakage, and is designed to measure the intensity of a mechanical/physical impact to the glass window or door.

Figure 2:
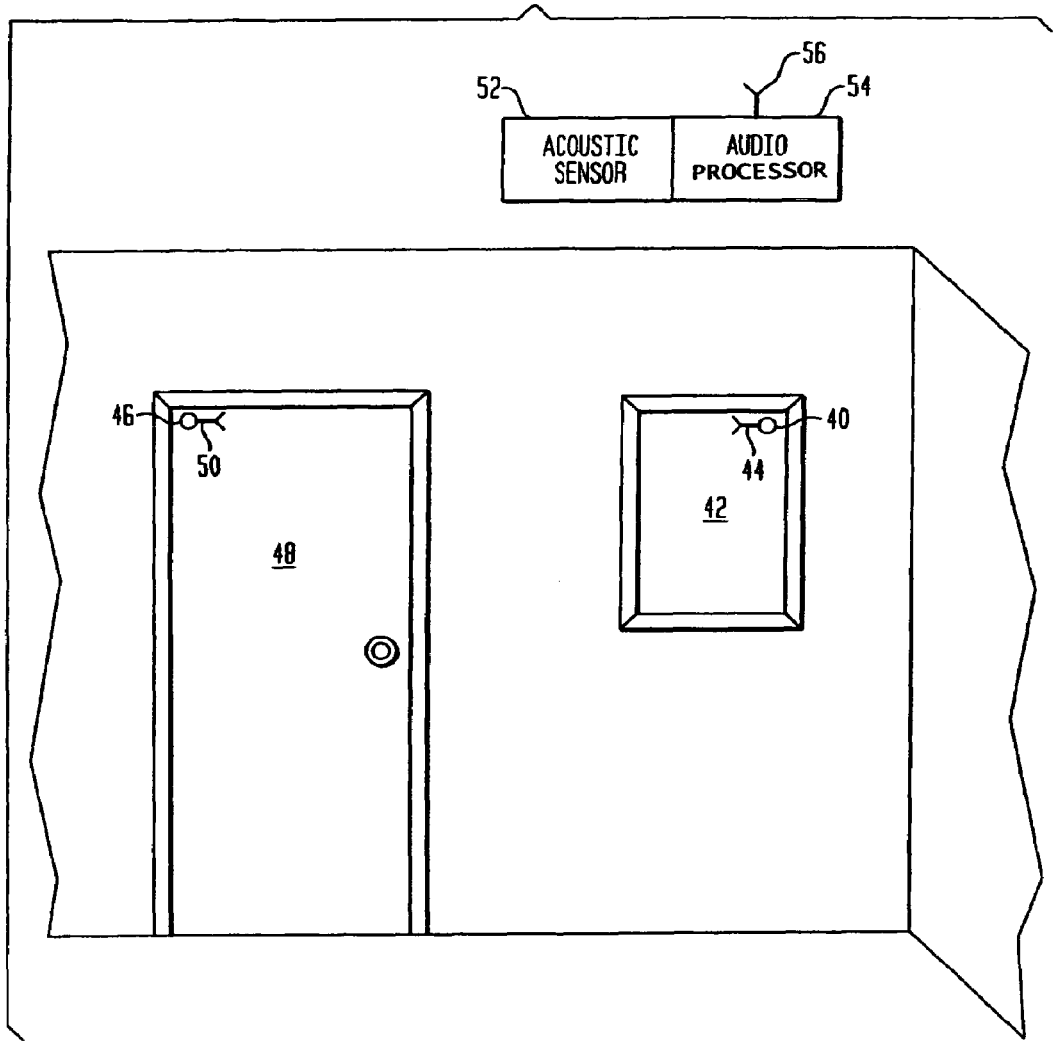
FIG. 2 illustrates a residential or commercial premises protected by a security system wherein, pursuant to the present invention, an intrusion security glass breakage detector comprises an impact sensor mounted on a glass window or door, and an acoustic glass breakage sensor.

FIG. 2 illustrates a residential or commercial premises protected by a security system wherein, pursuant to the present invention, an intrusion security glass breakage detector comprises an impact sensor 40 mounted on a framed glass window 42, which is typical of other glass windows on the premises, an impact sensor 46 mounted on a glass door 48, which is typical of other glass doors on the premises, and an acoustic glass breakage sensor 52 centrally and strategically mounted on the ceiling or a wall of the protected premises to monitor the premises for acoustic sounds indicative of the breakage of glass. The acoustic glass breakage sensor 52 includes an audio processor 54 for analyzing the monitored sounds to determine if they have acoustic characteristics similar to and indicative of a glass window or door being broken.

Figure 3:
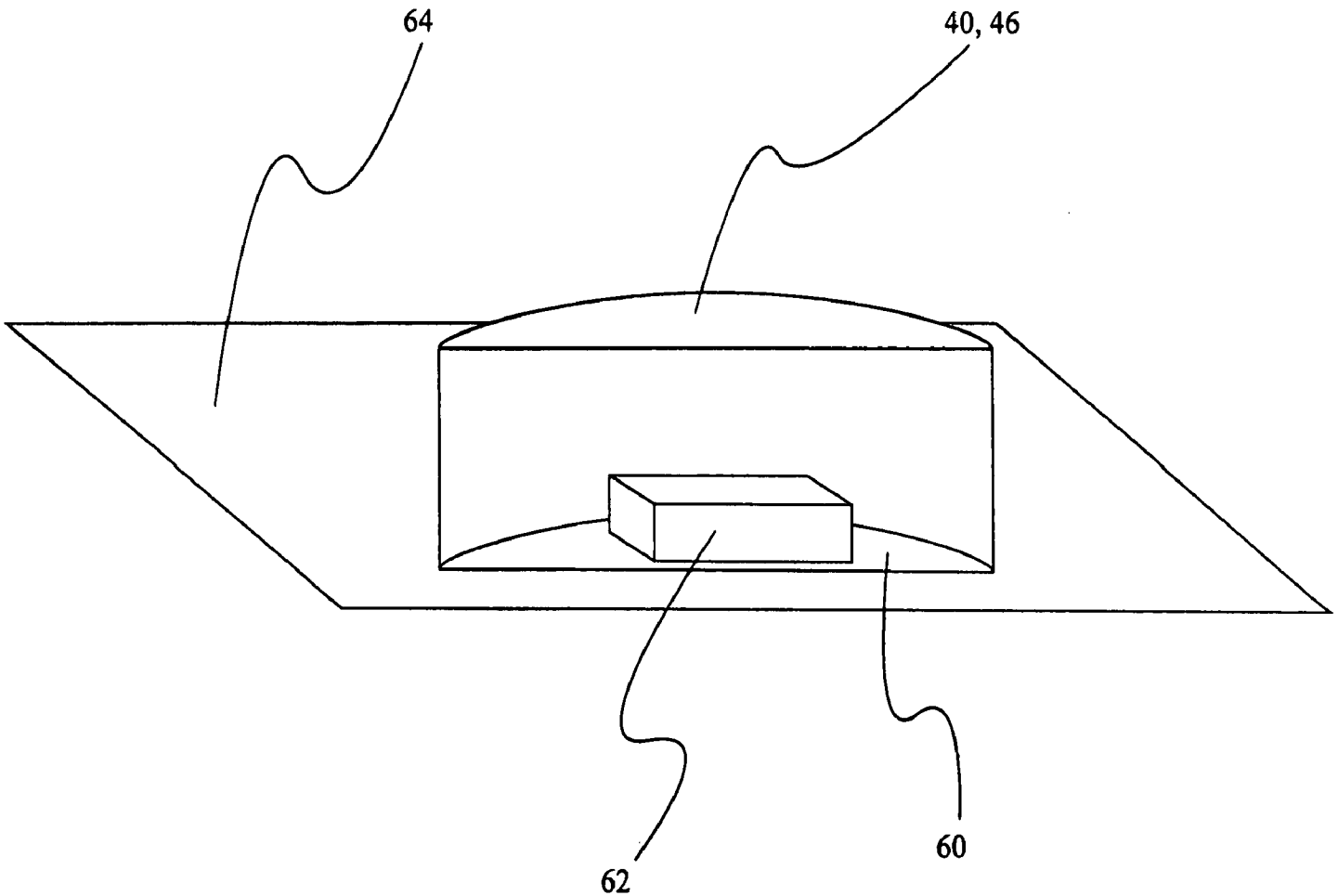
FIG. 3 illustrates a cross-sectional view of an exemplary impact sensor according to the invention.

Each impact sensor 40, 46 can be a piezoelectric type of sensor or a MEMS (micro-electrical mechanical system) type of sensor that is simply adhered to the glass surface of the window or door. As depicted in FIG. 3, either type of sensor can be designed like a small disc or drum, having a base surface 60 spaced from and parallel to the glass surface 64, such that a mechanical/physical impact to the glass surface 64 causes the base surface 60 to vibrate in resonance with the glass surface 64. A sensitive element 62 of the impact sensor 40, 46 is mounted on the base surface 60 of the disc or drum such that it is vibrated by the disc or drum surface when the latter is subjected to an impact. The Ademco division of Honeywell International Inc. produces a model 5800 SS1 wireless shock sensor that can be appropriately employed with the present invention.

If the intensity of a physical impact to a glass window 42 or door 48, as measured by the impact sensor 40, 46 is consistent with that required to break the glass window or door, the impact sensor 40, 46 generates a first enable signal for the security system 10. The acoustic sensor 52 also monitors the room for sounds consistent with that of breaking a framed glass window or door. If a sound in the room is detected by the acoustic sensor that is consistent with that of breaking a glass window or door, the acoustic sensor 52 generates a second enable signal for the security system. Both the first and second enable signals must be generated for an alarm to be annunciated by the security system 10. Moreover, one embodiment can impose an additional timing criteria of receipt of the impact first enable signal followed by receipt of the acoustic second enable signal within a predetermined time period. Both technologies complement each other. The impact sensor prevents the annunciation of false alarms from sounds in the room that would fool an acoustic sensor. The acoustic sensor prevents the annunciation of false alarms from impacts to the glass that do not result in breakage of the glass.

Upon activation by an impact/shock, in a first embodiment of the invention the impact/shock sensor 40, 46 transmits a local signal, preferably a wireless RF signal by an RF transmitter and antenna 44, 50, to the acoustic sensor 52. If the acoustic sensor 52 also acoustically detects a sound indicative of breaking of glass within a given window of time, the acoustic sensor 52 transmits a signal, preferably a wireless signal by an RF transmitter and antenna 56, to the security system control panel 12 which then annunciates an alarm signal.

In a second embodiment of the invention, upon activation by an impact/shock, the impact/shock sensor 40, 46 transmits a local signal, preferably a wireless RF signal by the RF receiver and antenna 44, 50, directly to the security system control panel 12. If the acoustic sensor 52 also acoustically detects a sound indicative of breaking of glass, the acoustic sensor 52 also transmits a local signal, preferably a wireless RF signal by the RF receiver and antenna 56, to the security system control panel 12, which upon receipt of both signals within a given window of time, annunciates an alarm signal.

Preferred embodiments of the present invention can employ wireless transmissions, such as short range RF transmissions, acoustic chirp transmissions, IR transmissions, etc.

While several embodiments and variations of the present invention for a dual technology glass breakage detector are described in detail herein, it should be apparent that the disclosure and teachings of the present invention will suggest many alternative designs to those skilled in the art.

What is claimed is:

1. A dual technology glass breakage detector for a security system that detects the breaking of glass in a window or door comprising:

an acoustic glass breakage sensor for detecting a sound of breaking glass within a premises protected by the security system, said acoustic glass breakage sensor is not mounted on a glass window or door;

an impact sensor mounted on the glass window or door for detecting a physical/mechanical impact to the glass of the window or door to verify that there is a physical/mechanical impact to the glass window or door said acoustic glass breakage sensor and the impact sensor are separately mounted at a fixed remote distance from each other, wherein the security system includes a control panel, the impact sensor, upon sensing a physical/mechanical impact to the glass of the window or door consistent with that required to break the glass, transmits a first enable signal to the control panel and the acoustic glass breakage sensor, upon acoustically detecting a sound indicative of breaking of glass, transmits a second enable signal to the control panel, said control panel annunciates an alarm signal only after the receiving said first and second enable signals from both the acoustic glass breakage sensor and the impact sensor, such that the impact sensor prevents the annunciation of false alarms from sounds that might fool the acoustic glass breakage sensor, and the acoustic glass breakage sensor prevents the annunciation of false alarms from impacts to the glass window or door that do not result in breakage of glass.

2. The dual technology glass breakage detector of claim 1, including a plurality of impact sensors mounted on a plurality of glass windows or doors in the premises protected by the security system.

3. The dual technology glass breakage detector of claim 1, including a single acoustic glass breakage sensor mounted within a room of the premises protected by the security system, and a plurality of impact sensors mounted on a plurality of glass windows or doors in the room in the premises protected by the security system.

4. The dual technology glass breakage detector of claim 3, wherein the acoustic sensor is mounted on a ceiling or wall of the room in the premises protected by the security system.

5. The dual technology glass breakage detector of claim 1, wherein the acoustic glass breakage sensor includes an audio processor for analyzing monitored sounds to determine if the monitored sounds have acoustic characteristics similar to and indicative of a glass window or door breaking.

6. The dual technology glass breakage detector of claim 1, wherein the impact sensor is a piezoelectric sensor attached to a glass surface of the glass window or door.

7. The dual technology glass breakage detector of claim 1, wherein the impact sensor is a MEMS (micro-electrical mechanical system) sensor attached to a glass surface of the glass window or door.

8. The dual technology glass breakage detector of claim 1, wherein the impact sensor comprises a small disc or drum, having a base surface spaced from and parallel to the glass surface, such that a mechanical/physical impact to the glass surface causes the base surface to vibrate in resonance with the glass surface, and a sensitive element of the impact sensor is mounted on the base surface of the disc or drum such that it is vibrated by the disc or drum surface when the glass window or door is subjected to an impact.

9. A dual technology glass breakage detector for a security system that detects the breaking of glass in a window or door comprising:

an acoustic glass breakage sensor for detecting a sound of breaking glass within a premises protected by the security system, said acoustic glass breakage sensor is not mounted on a glass window or door;

an impact sensor mounted on the glass window or door for detecting a physical/mechanical impact to the glass window or door to verify that there is a physical/mechanical impact to the glass window or door said acoustic glass breakage sensor and the impact sensor are remotely located from each other;

wherein the security system annunciates an alarm signal only after the generation of signals from both the acoustic glass breakage sensor and the impact sensor, such that the impact sensor prevents the annunciation of false alarms from sounds that might fool the acoustic glass breakage sensor, and the acoustic glass breakage sensor prevents the annunciation of false alarms from impacts to the glass window or door that do not result in breakage of glass wherein:

the security system includes a security system control panel;

the impact sensor, upon sensing a physical/mechanical impact to the glass of the window or door, transmits a local signal to the acoustic glass breakage sensor; and the acoustic glass breakage sensor, upon acoustically detecting a sound indicative of breaking of glass within a given window of time of receiving the local signal from the impact sensor, transmits a local signal to the security system control panel which then annunciates an alarm signal.

10. The dual technology glass breakage detector of claim 9, wherein the impact sensor transmits a local wireless RF signal to the acoustic glass breakage sensor, and the acoustic glass breakage sensor transmits a local wireless RF signal to the security system control panel.

11. The dual technology glass breakage detector of claim 1, wherein:

the security system control panel annunciates an alarm signal if it receives the first and second enable signals within a giving window of time.

12. The dual technology glass breakage detector of claim 11, wherein the impact sensor transmits a wireless RF signal to the security system control panel, and the acoustic glass breakage sensor transmits a wireless RF signal to the security system control panel.

13. The dual technology glass breakage sensor of claim 1, in a security system having a security system control panel and intrusion, occupancy and environmental condition sensors, and wherein the acoustic glass breakage sensor communicates with the security system control panel.

14. The dual technology glass breakage detector of claim 1, in a wireless security system having a security system control panel including an RF transceiver to transmit and receive RF transmitted data, and the acoustic glass breakage sensor including an RF transmitter for transmitting short range RF communication messages to the control panel.

* * * * *